United States Patent [19]

Ono

[11] 3,996,739

[45] Dec. 14, 1976

[54] EXHAUST GAS PURIFYING SYSTEM

[75] Inventor: Hiroaki Ono, Kyoto, Japan

[73] Assignee: Mitsubishi Jidosha Kogyo Kabushiki Kaisha, Tokyo, Japan

[22] Filed: July 28, 1975

[21] Appl. No.: 599,677

[30] Foreign Application Priority Data

Feb. 27, 1975 Japan ..... 50-24571

[52] U.S. Cl. ..... 60/290

[51] Int. Cl.[2] ..... F02B 75/10

[58] Field of Search ..... 60/290; 123/119 A, 117 A

[56] References Cited

UNITED STATES PATENTS

| | | | |
|---|---|---|---|
| 3,906,723 | 9/1975 | Matumoto | 60/290 |
| 3,919,843 | 11/1975 | Arnaud | 60/289 |
| 3,920,041 | 11/1975 | Gropp | 123/117 A |
| 3,931,710 | 1/1976 | Hartel | 60/290 |

*Primary Examiner*—Douglas Hart
*Attorney, Agent, or Firm*—Oldham & Oldham Co.

[57] ABSTRACT

An exhaust gas purifying system comprising diaphragm means operating a secondary air control valve and having first and second chambers, supply pressure changeover means operated by an operating mechanism for selectively supplying negative or positive pressure to the first chamber, thereby controlling the operation of the control valve to control supply of the secondary air to an exhaust system of an engine. Delay means is provided between the changeover means and the first pressure chamber to delay the operation of the control valve, thereby purifying the exhaust gas effectively at any operating condition of the engine.

10 Claims, 11 Drawing Figures

EXHAUST GAS PURIFYING SYSTEM

SUMMARY OF INVENTION

This invention relates to exhaust gas purifying systems.

According to the invention, there is provided an exhaust gas purifying system comprising a diaphragm means having first and second pressure chambers defined by a diaphragm and operating a secondary air control valve therethrough, said first pressure chamber being supplied selectively with positive pressure or negative pressure while said second pressure chamber is supplied continuously with the negative pressure, supply pressure changeover means for selectively switching supply of the positive pressure generated by a secondary air supply source or the negative pressure in an intake manifold to said first pressure chamber of the diahragm means, an operating mechanism for operating said supply pressure changeover means, and a delay means being located in a pressure communicating passage between said supply pressure changeover means and said first pressure chamber and consisting of a check valve and a restriction means parallel thereto.

In the exhaust gas purifying system according to the invention, controlled operation of the diaphragm means is established since the supply pressure changeover means acts to change over the supply of the positive or negative pressure to the diaphragm means, as desired. Also, the changeover means is provided with the operating mechanism, such as solenoid, which operates upon detection of a high loading condition of an engine. Consequently, purification of the exhaust gas is expedited by delaying the termination of the secondary air supply to an exhaust system of the engine at normal accelerating condition thereof, since the positive pressure is slowly supplied to the first pressure chamber of the diaphragm means through the delay means consisting of the check valve and the restriction means so that operation of a secondary air control valve is delayed. Also, at the continuous high loading condition of the engine, overheating of the exhaust system is prevented by termination of the secondary air supply.

BRIEF DESCRIPTION OF THE DRAWINGS

This invention will now be explained, by way of example, with reference to the accompanying drawings, in which.

DESCRIPTION OF THE PREFERRED EMBODIMENTS

Figure 1:
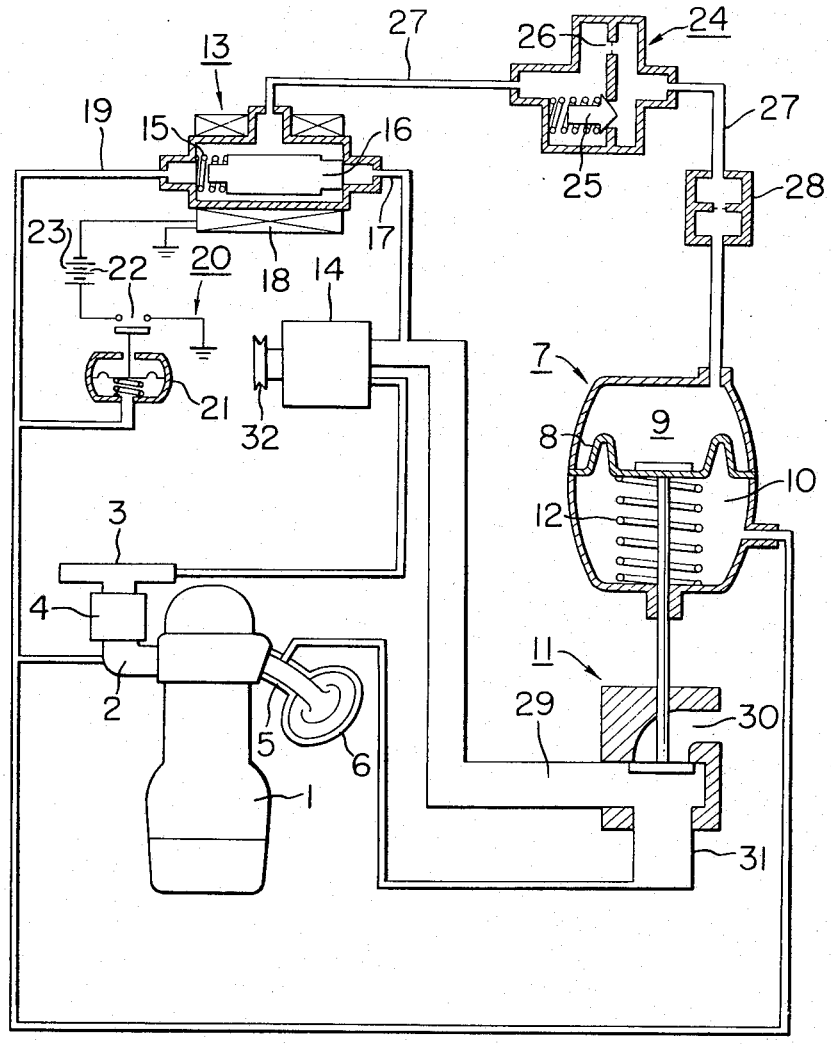
FIGS. 1 to 4 show respectively schematic explanation views of first embodiment of the exhaust gas purifying system according to the invention at different operational conditions.

Referring to FIGS. 1 to 4, there is shown a first embodiment of the exhaust gas purifying system. An intake system of an engine 1 of a conventional type includes a carburetor 4 having an air cleaner 3 and connected through an intake manifold 2 to the engine 1.

The exhaust gas purifying system is provided in an exhaust system of the engine 1. The purifying system includes an exhaust gas treating device 6, such as a thermal reactor or oxidizing catalytic convertor, which is connected to an exhaust manifold 5. The purifying system also includes a diaphragm means 7 for operating a secondary air control valve 11 which controls secondary air supply from a secondary air supply source to the exhaust manifold 5. The diaphragm means 7 has first and second pressure chambers 9 and 10 defined by a diaphragm 8. The first chamber 9 is supplied selectively with positive pressure or negative pressure, while the second chamber 10 is supplied continuously with the negative pressure. The diaphragm 8 operates the control valve 11 and is urged upwardly by a spring 12 thereby normally biasing the control valve 11 to a secondary air supply position.

A supply pressure changeover means 13 operates to switch selectively the supply of the positive pressure generate by a secondary air pump 14 forming said secondary air supply source or the negative pressure in the intake manifold 2 to the first chamber 9 of the diaphragm means 7. The changeover means 13 includes a valve 16 which is biased by a spring 15 to close a passage 17 communicated to the outlet side of the secondary air pump 14. When a solenoid 18 constituting an operating mechanism for operating the supply pressure changeover means 13 is actuated, the valve 16 is moved against the biasing force of the spring 15 to close a passage 19 for supplying the negative pressure in the intake manifold 2 and to open the passage 17. The actuation of the solenoid 18 is effected by an operating circuit 20. The circuit 20 includes a switch 22 controlled by a diaphragm means 21 and an electrical source 23 which is connected to the solenoid 18 through the switch 22. The diaphragm means 21 is responsive to the negative pressure in the intake manifold 2 and adapted to operate the switch 22 when it detects the high loading condition of the engine 1.

A delay means 24 is provided in a pressure communicating passage 27 between the first pressure chamber 9 of the diaphragm means 7 and the supply pressure changeover means 13. The delay means 24 consists of a check valve 25 and restriction means 26 connected parallel thereto. Another restriction means 28 is provided in the passage 27 between the delay means 24 and the chamber 9.

The secondary air control valve 11 is adapted to divert a secondary air supply passage 29 to an atmospheric passage 30 or to a secondary air supply passage 31. The secondary air pump 14 is actuated through a pulley 32 and belt (not shown) by the engine 1.

In operation of the above described embodiment, as the negative pressure in the intake manifold 2 is high at low and medium loading conditions of the engine 1 and consequently the diaphragm means 21 opens the switch 22 to deenergize the solenoid 18 as in FIG. 1, the supply pressure changeover means 13 supplies the negative pressure in the intake manifold 2 to the first pressure chamber 9. The diaphragm 8 of the diaphragm means 7 is urged upwardly by the spring 12 to cause the secondary air control valve 11 to open the secondary air supply passage 31. The secondary air from the pump 14 is supplied to the exhaust gas treating device 6 through the passages 29 and 31 to oxidize effectively unburned ingredients in the exhaust gas.

Figure 2:
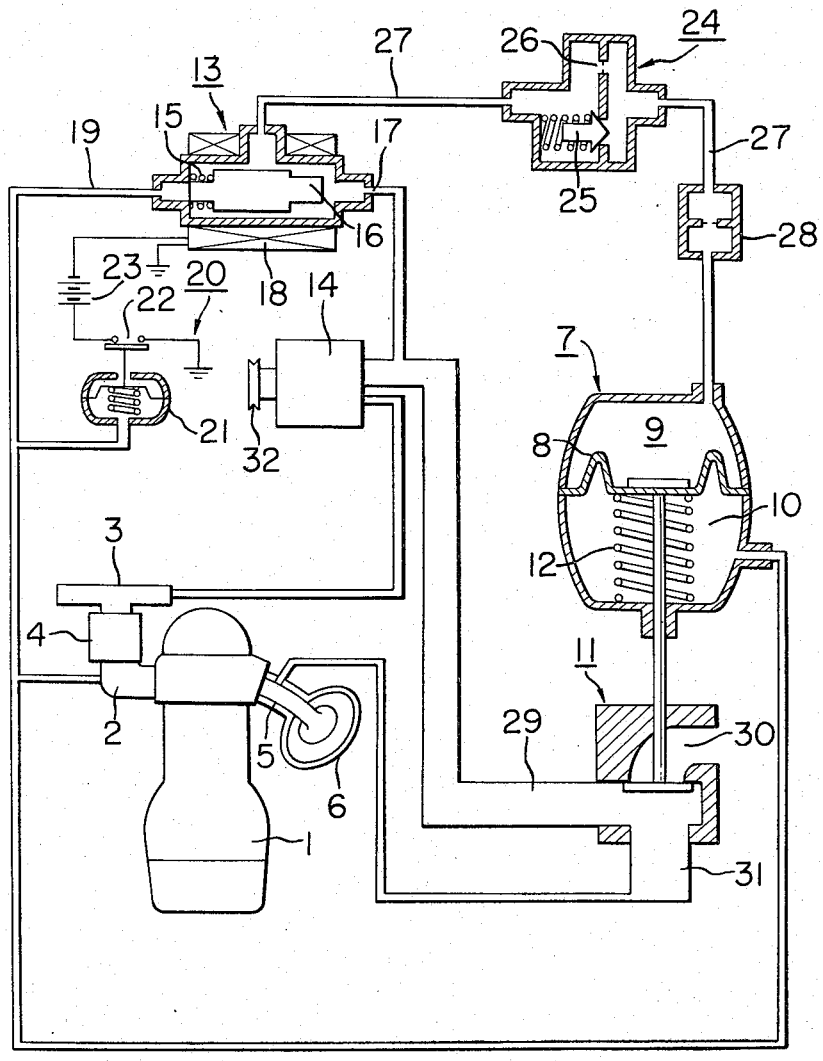

In the accelerating condition of the engine 1, the negative pressure in the intake manifold 2 decreases so that the diaphragm means 21 closes the switch 22 to energize the solenoid 18, as shown in FIG. 2. Upon energization of the solenoid 18, the valve 16 of the changeover means 13 is moved to a position shown in FIG. 2, thereby permitting the positive pressure from the pump 14 to be supplied to the first pressure chamber 9 of the diaphragm means 7. At this time, the check valve 25 in the delay means 24 is closed by the positive pressure acting onto the valve 25. Therefore, the positive pressure is supplied through the restriction means 26 and then through the restriction means 28 to the pressure chamber 9 so that the pressure of a predetermined level is built up therein after a predetermined time, for example ten seconds, has passed. Since the pressure in the chamber 9 will not increase rapidly, the control valve 11 permits the secondary air to be supplied to the exhaust system for example to the exhaust manifold 5 just after the acceleration in which the exhaust gas contains a large amount of the unburned ingredients, thereby expediting the oxidation thereof within the exhaust gas treating device 6 to purify effectively the exhaust gas.

Figure 3:
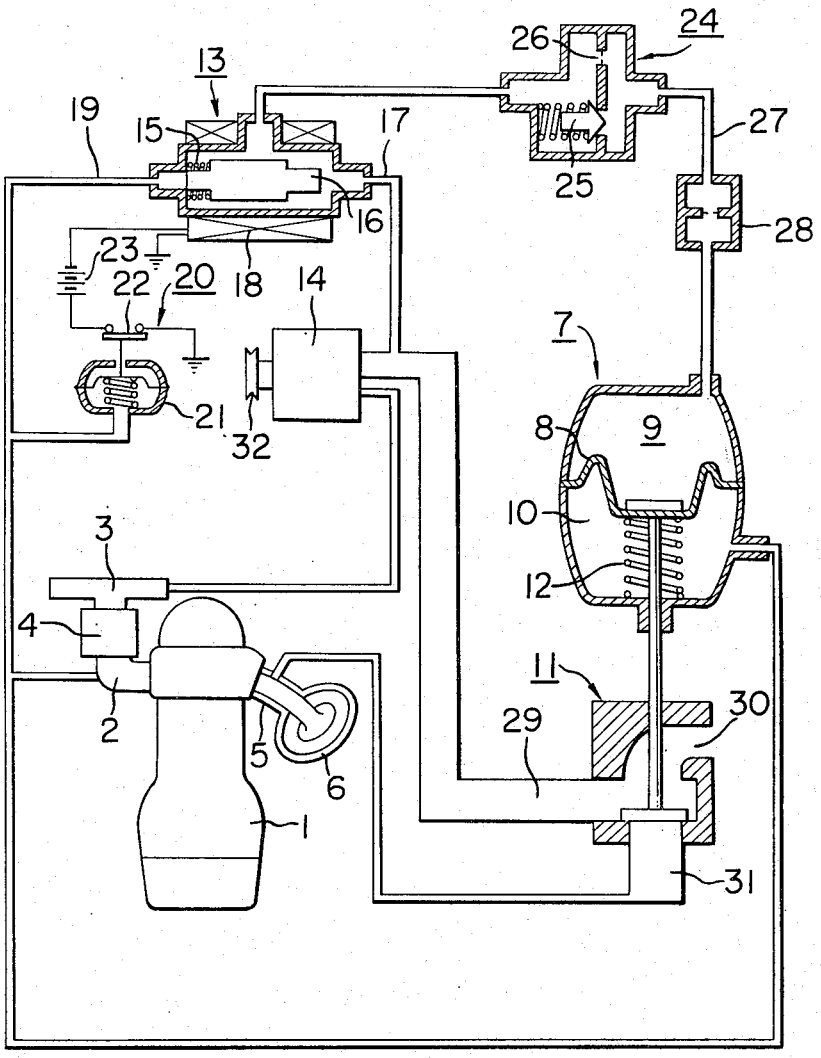

If the high loading condition of the engine is maintained after said acceleration, the positive pressure supplied to the first pressure chamber 9 through the restriction means 26 and 28 operates the diaphragm means 7 to cause the control valve 11 to open the atmospheric passage 30 and close the passage 31, as shown in FIG. 3. Thus, the supply of the secondary air to the exhaust system is interrupted thereby preventing abnormal overheating of the exhaust gas treating device 6.

Figure 4:
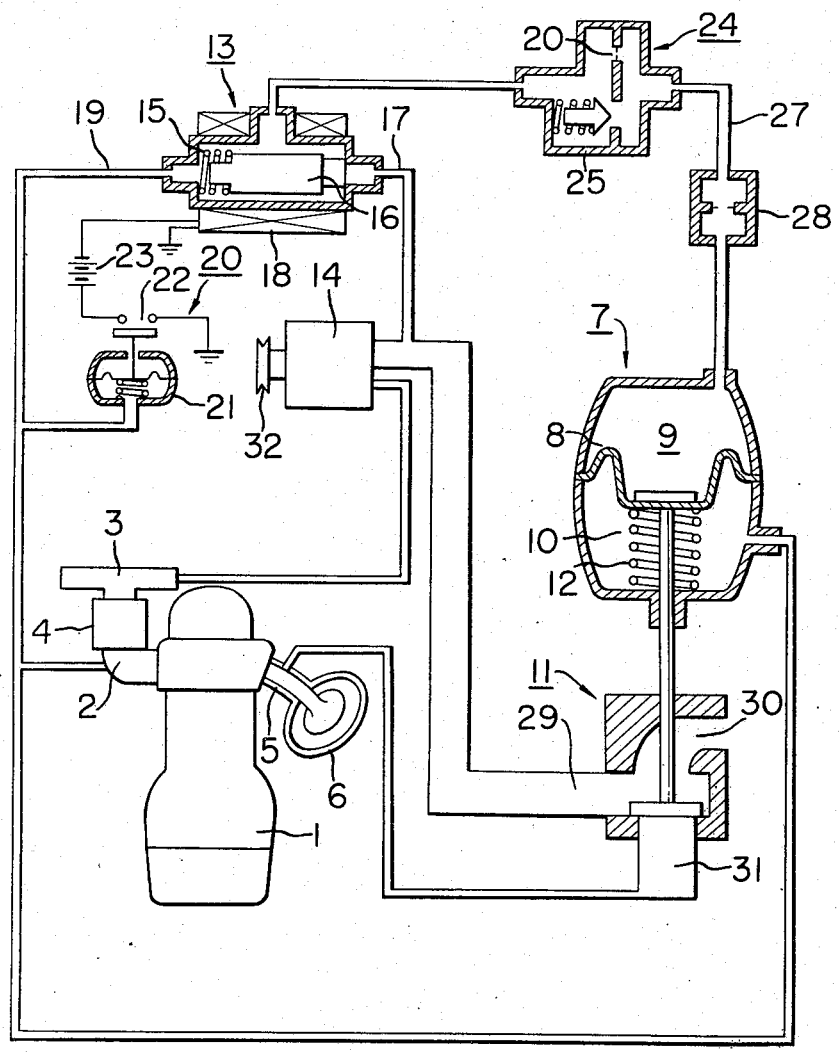

Also, in the decelerating condition of the engine, as shown in FIG. 4, the diaphragm means 21 opens the switch 22 due to increase of the negative pressure in the intake manifold 2 to deenergize the solenoid 18, thereby supplying the negative pressure to the pressure chamber 9 through the supply pressure changeover means 13. At this time, the negative pressure is supplied to the first and second pressure chambers 9 and 10. The negative pressure in the intake manifold 2 is directly supplied to the chamber 10, while this pressure is supplied to the chamber 9 after the check valve 25 is opened against the biasing force of the spring and the supply of the pressure is delayed for a predetermined time, for example two seconds, by the restriction means 28. Thus, just after the initiation of deceleration, a difference of pressure between the first and second pressure chambers 9 and 10 is produced to cause the diaphragm 8 to move downwardly in opposition to the biasing force of the spring 12, thereby moving the secondary air control valve 11 to open the atmospheric passage 30. Therefore, the supply of the secondary air to the exhaust system is interrupted to prevent the generation of afterburn during the predetermined time just after the deceleration in which the exhaust has contains a large amount of unburned ingredients likely to cause the afterburn.

If the decelerating condition is maintained for a time more than said predetermined time for example two seconds after the initiation of deceleration, the pressures in the first and second pressure chambers 9 and 10 become equal. Consequently, the diaphragm 8 is moved by the spring 12 to be brought into the same position shown in FIG. 1, so that the secondary air is resupplied to the exhaust system to expedite the purification of the exhaust gas.

According to the above described embodiment of this invention, reliable operation of the secondary air control valve is established, since the positive pressure generated by the secondary air pump 14 and the negative pressure in the intake manifold 2 are changed over to be supplied to the diaphragm means 7 which operates the control valve. Due to the provision of the operating mechanism for the supply pressure changeover means which is operated upon detection of the high loading condition of the engine, the exhaust gas purifying system of this invention can be controlled to expedite the purification of the exhaust gas in the normal accelerating condition as well as in the medium loading condition of the engine. Also, the system prevents, effectively, any abnormal overheating of the exhaust system by interrupting the supply of secondary air in the continuous high loading condition and the afterburn by momentarily interrupting the supply of secondary air just after the initial deceleration during the decelerating condition.

In said first embodiment, the solenoid, operated upon the detection of the high loading condition of the engine, is provided in the supply pressure changeover means as a part of the operating mechanism therefor. A mechanism for detecting said high loading condition may be a means for detecting a degree of opening of a throttle valve of the carburetor, instead of the diaphragm means 21.

Figure 5:
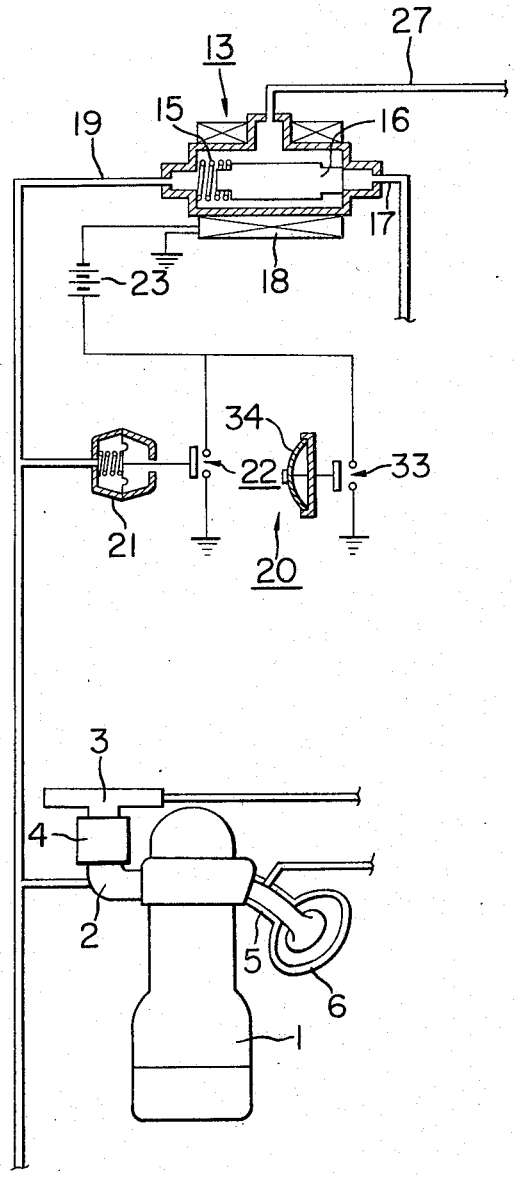
FIG. 5 shows a schematic explanation view of the exhaust gas purifying system having a temperature sensing switch, similar to FIG. 1, FIGS. 6 to 9 show respectively schematic explanation views of second embodiment of the exhaust gas purifying system according to the invention at different operational conditions.

Also, the operating mechanism may further comprise a mechanism which is operated upon sensing a temperature of cooling water, engine room or environment around the exhaust system. In this case, as shown in FIG. 5, the operating circuit 20 for the solenoid 18 is provided with a temperture sensing switch 33 operated by a bimetal 34 and connected in parallel with the switch 22 operated by the diaphragm means 21. In the high loading condition of the engine, the switch 22 is close to achieve the same operational effect as in the first embodiment. In a high temperature condition, the switch 33 is closed upon sensing of a predetermined temperature of cooling water, engine room or environment around the exhaust system by the bimetal 34. In this result, the solenoid 18 is operated to supply the positive pressure from the secondary air pump 14 to the first pressure chamber 9 of the diaphragm means 7, so that the secondary air control valve 11 moves to open the atmospheric passage 30 to interrupt the supply of the secondary air to the exhaust system, thereby preventing abnormal overheating thereof.

FIGS. 6 to 9 show a second embodiment of this invention. In this embodiment, the invention is applied to our Japanese patent application No. 101,121/74 filed on Sept. 2,1974. The first embodiment is so arranged that the changeover of the supply of the positive pressure or negative pressure is effected by operation of the solenoid 18. However, in this embodiment, there is provided supply pressure changeover means which itself senses variations of the positive and negative pressures and changes over the supply thereof. Elements identical to or substantially same as those in the first embodiment are indicated by the same numerals.

Figure 6:
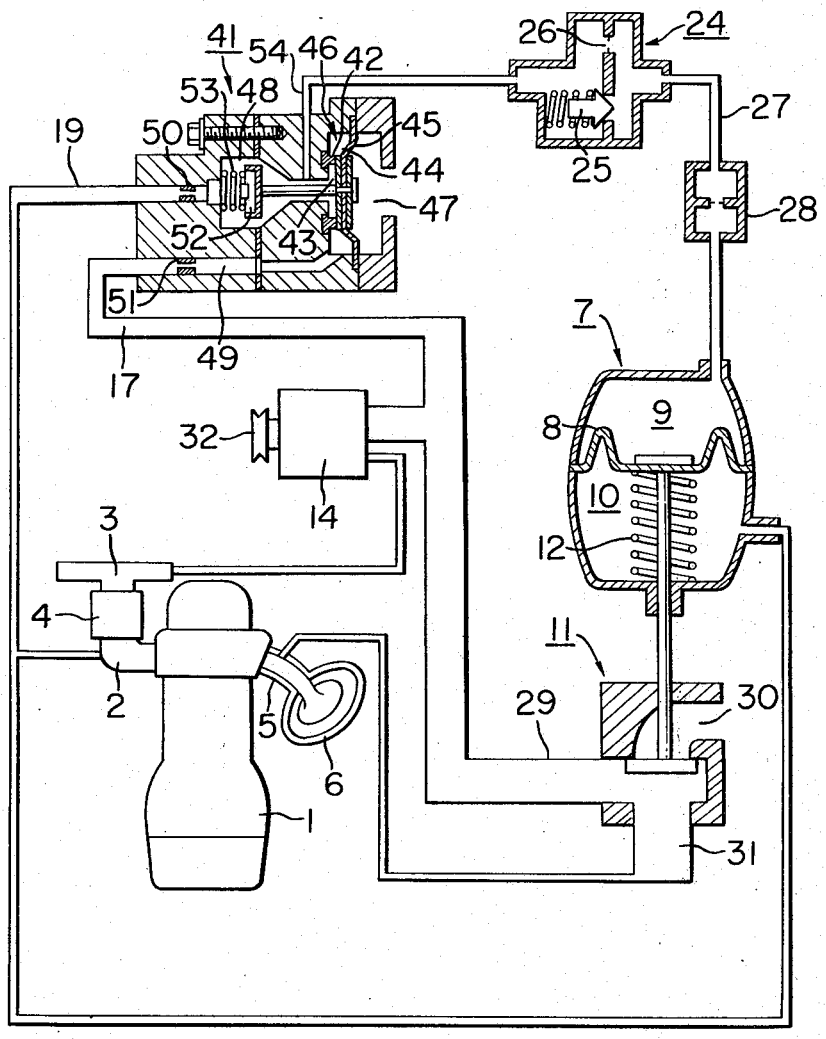

A pressure selecting valve 41 forming the supply pressure changeover means in the first embodiment itself senses the positive pressure generated by the secondary air pump 14 forming the secondary air supply source and the negative pressure in the intake manifold 2 and changes over selectively the supply of the negative or positive pressure to the first pressure chamber 9 of the diaphragm means 7. As shown in FIG. 6, the pressure selecting valve 41 includes a variable pressure chamber 46 having first and second pressure chambers 43 and 44 at one side of a diaphragm 45 and a constant pressure chamber 47 opened to the atmosphere at the other side of the diaphragm. The first and second chambers 43 and 44 are separated by a valve seat having an annular projection 42. The diaphragm 45 is operated by a difference of pressure between the variable pressure chamber 46 and the constant pressure chamber 47. A first pressure passage 48 is continuously communicated to the first chamber 43. A second pressure passage 49 is continuously communicated to the second chamber 44. Each of the first and second passages 48, 49 has an orifice 50, 51 therein. The first pressure passage 48 has provided therein a negative pressure control valve 52 which is connected to the diaphragm 45 and normally urged towards its closed position by a spring 53. The diaphragm 45, control valve 52, spring 53 and chamber 46 and 47 form the operating mechanism in the first embodiment. An outlet passage 54 is communicated to the first pressure passage 48 between the valve 52 and the first pressure chamber 43. The first pressure passage 48 is supplied with the negative pressure in the manifold 2 of the engine 1 through the orifice 50, while the second pressure passage 49 is supplied with the positive pressure generated by the pump 14 through the orifice 51.

Figure 10:
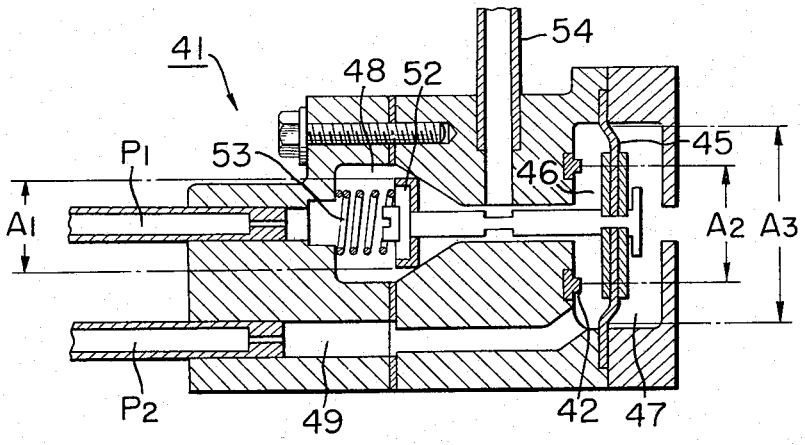
FIG. 10 shows an enlarged cross section of the pressure selecting valve shown in FIGS. 6 to 9.

In FIG. 10, assuming that $A_1$ is an area of the negative pressure control valve 52; $A_2$ is an area of the inner circumferential portion of the annular projection 42; $A_3$ is a total effective area of the diaphragm 45; $P_1$ is the negative pressure in the intake manifold; $P_2$ is the positive pressure generated by the secondary air pump; and F is a biasing force of the spring 53, a force of the negative pressure $P_1$, which is increased to move the diaphragm 45 towards the left when the diaphragm is in the right position shown in FIG. 10, is represented by the following formula;

$$P_1 \geqq \frac{A_3 - A_1}{A_1} \times P_2 + \frac{F}{A_1} \qquad \text{(a)}$$

Also, a force of the negative pressure $P_1$, which is decreased to move the diaphragm 45 towards the right when the diaphragm 45 is moved and seats on the valve seat, is represented by the following formula;

$$P_1 \leqq \frac{A_3 - A_2}{A_2} \times P_2 + \frac{F}{A_2} \qquad \text{(b)}$$

Figure 11:
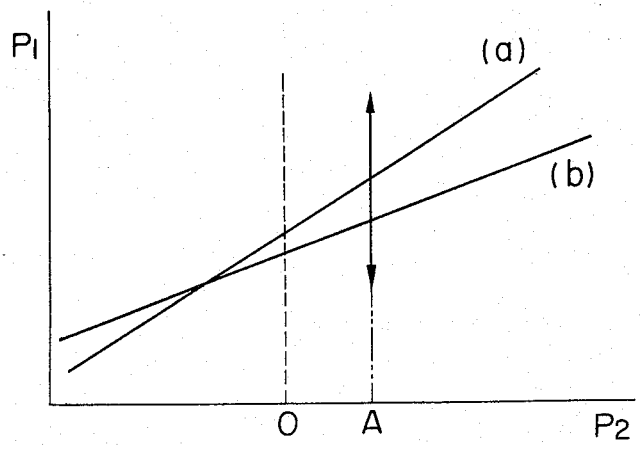
FIG. 11 is a diagram showing operation of the pressure selecting valve in FIG. 10.

The above formulas (*a*) and (*b*) will be explained in relation to FIG. 11. When the pressure $P_2$ from the pump 14 is of constant value, that is, revolutions of the engine 1 is maintained constant as shown in a chain line A, the secondary air is supplied continuously to the exhaust system at the low loading or negative loading of the engine where the degree of opening of the throttle valve is low or minimum. That is, when the negative pressure $P_1$ in the intake manifold 2 becomes greater than a limited value represented by the sign of equality in the formula (*a*), the diaphragm 45 seats on the valve seat, as shown in FIG. 6, so that the negative pressure $P_1$ in the intake manifold communicates to the first pressure chamber 9 of the diaphragm means 7 through the orifice. 50, outlet passage 54 and restriction means 26 and 28, while the second presure chamber 10 is supplied directly with the negative pressure $P_1$ in the manifold 2. As the difference of pressure between the first and second pressure chamber 9 and 10 will not be produced, the secondary air control valve 11 is operated by the spring 12 to open the secondary air supply passage 31, thereby purifying effectively the unburned ingredients contained in the exhaust gas.

Figure 7:
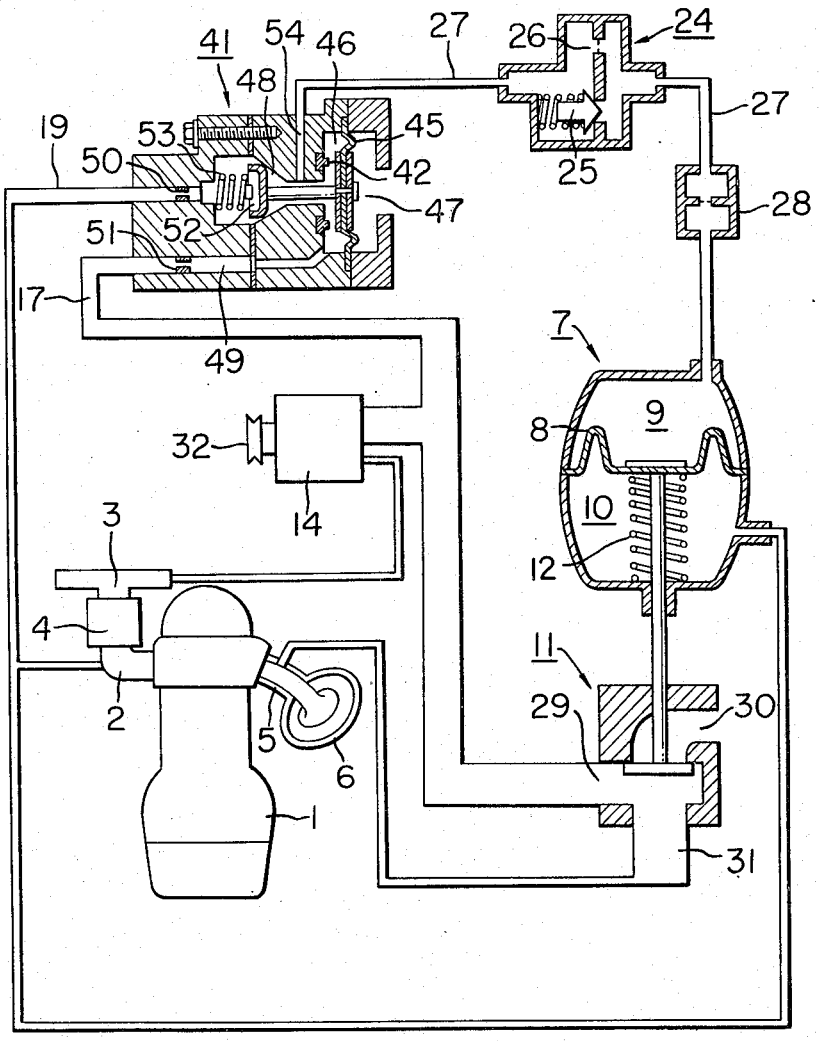
Figure 8:
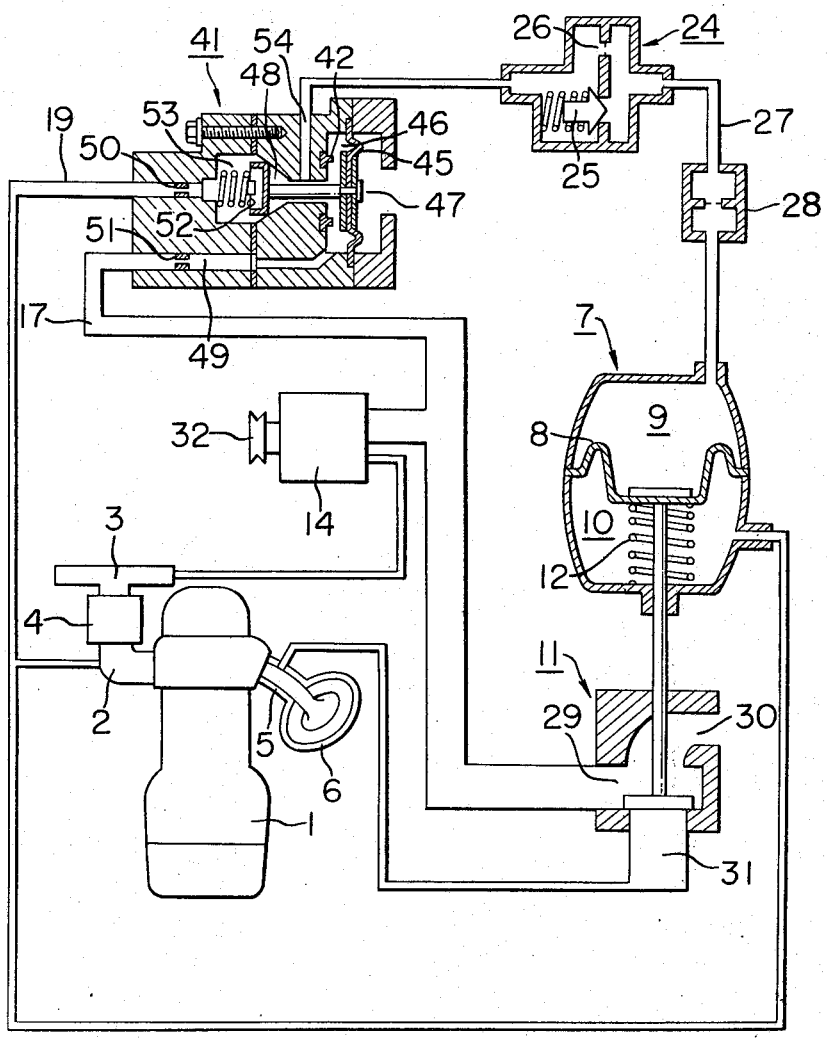

In the accelerating condition, the degree of opening of the throttle valve is high and the negative pressure $P_1$ in the intake manifold becomes lower than a limited value represented by the sign of equality in the formula (*b*). Consequently, as shown in FIG. 7, the diaphragm 45 is moved away from the valve seat to cause the negative pressure control valve 52 to seat onto the wall surface of the passage 48, so that the supply of the negative pressure to the outlet passage 54 is interrupted and the positive pressure from the secondary air pump 14 is introduced into the chamber 9 through the passages 49 and 54. At this time, the check value 25 is urged by the positive pressure to initiate the operation of the delay means 24. The positive pressure is supplied only through the restriction means 26 and 28 and transmitted to the first pressure chamber 9 after the predetermined time for example ten seconds has passed. Therefore, the pressure in the first pressure chamber 9 will not be increased abruptly. Thus, the secondary air control valve 11 acts to supply the secondary air to the exhaust manifold 5 in the exhaust system when the exhaust gas contains a large amount of the unburued ingredients just after acceleration, thereby expediting the oxidation of the latter within the exhaust gas treating device 6 to sufficiently purify the exhaust gas. If the high loading condition of the engine continues after the acceleration, as shown in FIG. 8, the positive pressure supplied through the restriction means 26 to the chamber 9 operates the diaphragm means 7 to cause the secondary air control valve 11 to open the atmospheric passage 30, thereby preventing the abnormal overheating of the exhaust system.

Figure 9:
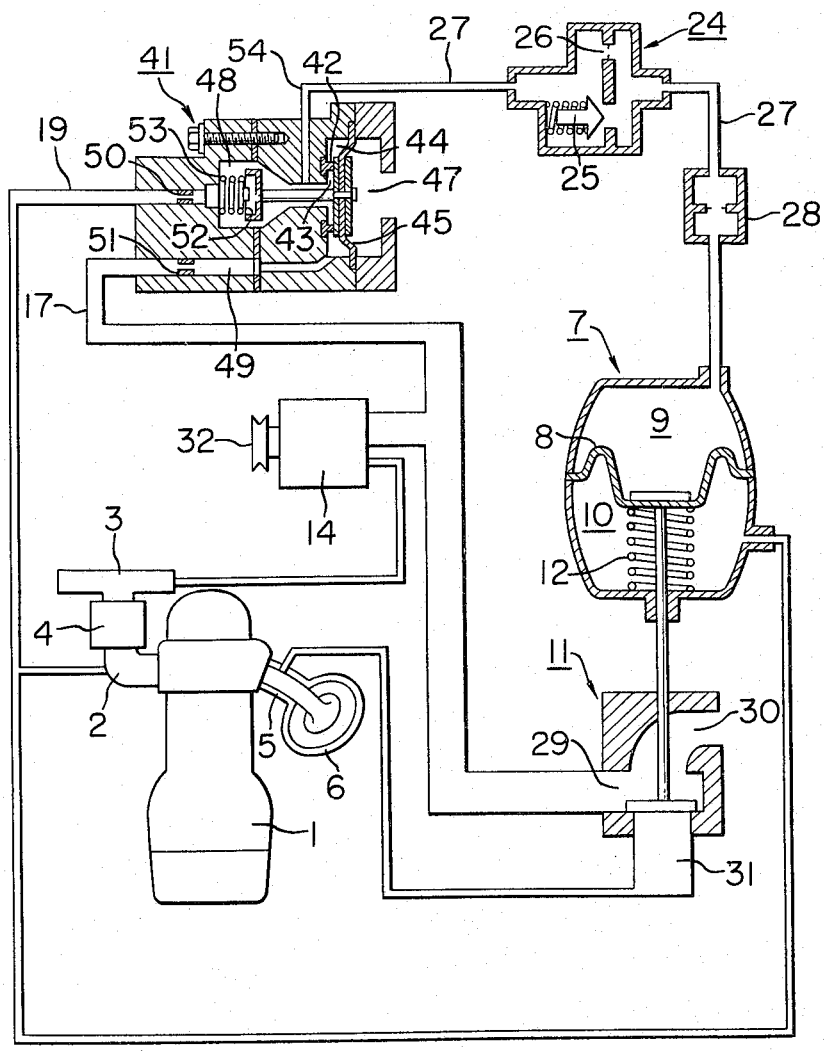

Also, in decelerating condition, as the negative pressure in the intake manifold 2 increases, the diaphragm 45 is operated to come into the position shown in FIG. 9 so that the first and second pressure chambers 9 and 10 is supplied with the negative pressure. The second chamber 10 is directly supplied with the negative pressure. The first chamber 9 is supplied with the negative pressure after this pressure opens the check valve 25 against the biasing force of the spring and then supply of the pressure is delayed for the predetermined time for example two seconds by the restriction means 28. In this result, the difference of pressure between the first and second pressure chambers 9 and 10 is produced just after the deceleration and causes the diaphragm 8 to move downwardly in opposition to the biasing force of the spring 12, thereby permitting the control valve 11 to open the atmospheric passage 30. Thus, when the exhaust gas contains a large amount of the unburned ingredients just after the initial deceleration so that the afterburn will be easily generated, the supply of the secondary air is terminated to prevent the afterburn. If the decelerating condition continues for a time more than said predetermind time for example two seconds after initiation of the deceleration, the pressures in the first and second chambers 9 and 10 become equal. As the diaphragm 8 is urged upwardly by the spring 12 to be brought into the position shown in FIG. 6, the secondary air is again supplied to the exhaust system to expedite the purification of the exhaust gas.

According to this embodiment, the same operational effect as in the first embodiment is achieved by the provision of the supply pressure changeover means, which itself senses the positive pressure generated by the secondary air pump and the negative pressure in the intake manifold to change over the supply thereof.

What is claimed is:

1. An exhaust gas purifying system comprising a diaphragm means having first and second pressure chambers defined by a diaphragm and operating a secondary air control valve therethrough, said first pressure chamber being supplied selectively with positive pressure or negative pressure while said second pressure chamber is supplied continuously with the negative pressure, a supply pressure changeover means for selectively switching supply of the positive pressure generated by a secondary air supply source or the negative pressure in an intake manifold of an engine to said first pressure chamber of the diaphragm means, an operating mechanism for operating said supply pressure changeover means, and a delay means being located in a pressure communicating passage between said supply pressure changeover means and said first pressure chamber and consisting of a check valve and a restriction means parallel thereto.

2. An exhaust gas purifying system according to claim 1, further comprising another restriction means provided between said delay means and said first pressure chamber for delaying the supply of the pressures to the latter.

3. An exhaust gas purifying system according to claim 2, wherein said check valve is closed when the positive pressure passes through said delay means, thereby delaying the supply of the positive pressure to said first pressure chamber for a first predetermined time by both of said restriction means, and opened when the negative pressure is communicated to the delay means, so that the supply of the negative pressure to said first pressure chamber is delayed for a second predetermined time by said another restriction means.

4. An exhaust gas purifying system according to claim 3, wherein said supply pressure changeover means includes a valve normally urged by a resilient means to a position in which the negative pressure in said intake manifold communicated to said first pressure chamber, said valve being moved against said resilient means to the other position in which the positive pressure from said pump is supplied to said first pressure chamber when the supply pressure changeover means is operated by said operating mechanism.

5. An exhaust gas purifying system according to claim 4, wherein said operating mechanism includes a solenoid which is actuated by an operating circuit having a switch and adapted to move said valve to said other position upon energization of the solenoid.

6. An exhaust gas purifying system according to claim 5, wherein said switch is controlled by a diaphragm means for detecting a high loading condition of the engine and closed when said diaphragm means detects said high loading condition.

7. An exhaust gas purifying system according to claim 6, wherein said solenoid is further energized by a temperature sensing switch for sensing temperature of cooling water, engine room or environment of an exhaust system of the engine, said temperature sensing switch being operated by a bimetal and connected to said solenoid in parallel with said switch.

8. An exhaust gas purifying system according to claim 3, wherein said supply pressure changeover means is formed by a pressure selecting valve, said pressure selecting valve comprising a diaphragm defining a constant pressure chamber and a variable pressure chamber having first and second portions separated by a valve seat, said first and second portions being communicated with said negative and positive pressures through first and second pressure passages respectively, a negative pressure control valve located in said first passage and connected to said diaphragm of the pressure selecting valve, and an outlet passage communicated to said first pressure passage between said negative pressure control valve and said first portion and to said first pressure chamber.

9. An exhaust gas purifying ststem according to claim 8, wherein said diaphragm, negative pressure control valve and variable and constant pressure chambers form said operating mechanism, said diaphragm being operated by difference of pressure between said variable and constant pressure chambers and adapted to move said negative pressure control valve away from a wall surface of the first passage when the negative pressure is increased, thereby permitting the negative pressure to communicate to said first pressure chamber through the first pressure passage and the outlet passage, but to move said valve into engagement with said surface when the negative pressure is decreased, thereby permitting the positive pressure to communicate to the first pressure chamber through the second pressure passage, said second and first portions and the outlet passage.

10. An exhaust gas purifying system according to claim 9, wherein each of said first and second pressure passages has provided therein an orifice.

* * * * *

UNITED STATES PATENT OFFICE

CERTIFICATE OF CORRECTION

Patent No. 3,996,739 Dated Dec. 14, 1976

Inventor(s) Hiroaki Ono

It is certified that error appears in the above-identified patent and that said Letters Patent are hereby corrected as shown below:

Column 1, line 19 - change "diahragm" to -- diaphragm --

Column 3, line 65 - insert -- upwardly -- between "moved and "by"

Column 5, line 20, change "chamber" to -- chambers --

Signed and Sealed this

Fifth Day of April 1977

[SEAL]

*Attest:*

RUTH C. MASON
*Attesting Officer*

C. MARSHALL DANN
*Commissioner of Patents and Trademarks*